United States Patent [19]

McAvoy

[11] 3,964,505

[45] June 22, 1976

[54] POWER TRANSMISSION

[75] Inventor: Dennis J. McAvoy, Lake Orion, Mich.

[73] Assignee: Sperry Rand Corporation, Troy, Mich.

[22] Filed: Feb. 10, 1975

[21] Appl. No.: 548,651

[52] U.S. Cl. ..... 137/106; 91/420; 91/455; 137/596.13; 137/596.18; 137/596.2

[51] Int. Cl.[2] ..... F15B 13/04

[58] Field of Search ..... 91/420, 455, 438, 446; 137/106, 596.12, 596.13, 596.14, 596.18, 596.2

[56] References Cited

UNITED STATES PATENTS

| | | | |
|---|---|---|---|
| 3,234,957 | 2/1966 | Allen | 137/596.12 X |
| 3,488,953 | 1/1970 | Haussler | 137/596.13 X |
| 3,680,588 | 8/1972 | Hufeld et al. | 137/596.18 |

*Primary Examiner*—Alan Cohan
*Assistant Examiner*—Gerald A. Michalsky
*Attorney, Agent, or Firm*—Theodore Van Meter

[57] ABSTRACT

A directional valve for hydraulic power transmission systems of the closed center type has a spool for directing fluid from inlet to either of two motor ports through one or the other of a pair of check valves for holding the load against dropping. A second pair of check valves connect from each motor port directly to a fluid return port independently of the spool. The second check valves have control chambers the maximum pressure in which is limited by a pilot relief valve to cause the check valve to act as a maximum pressure limiting valve for its motor port. A small pilot piston responsive to operating pressure in the opposite motor port can mechanically open the pilot relief valve thereby causing the second check valve to act as a counterbalance valve to prevent the motor from being driven by an overhauling load.

3 Claims, 2 Drawing Figures

POWER TRANSMISSION

Hydraulic power transmission systems such as are widely used on mobile material handling equipment use banks of spool type directional valves for controlling the operation of various fluid motors from a common hydraulic pressure supply such as a fixed displacement pump. As the power requirements for machines keep increasing, designers go to higher pressures which impose more stringent demands upon the performance of the control valves. The higher pressures aggravate the problem in two ways: they cause increased flow through the clearance between the spool and the bore of the body in which the spool slides and they cause increased distortion of the valve body tending to shift the valve bore portions out of true axial alignment and concentricity. Decreasing the diametrical clearance between spool and body is necessary to alleviate the first problem of leakage but an increased clearance is the only way to avoid spool sticking problems caused by body distortion. The use of load holding check valves has become common in order to prevent gradual load dropping due to spool leakage but this only partially relieves the problem and is inadequate for very high pressure systems.

It is an object of the present invention to provide an improved directional valve in which full control of motor movement may be obtained under high operating pressures without requiring extremely close fits between the spool and the body particularly at the metering orifice between the cylinder ports and the return passage.

A further object is to provide a valve of this character in which the pilot operated check valve serves to control flow from a motor port directly to a return passage, bypassing both a load holding check valve and the spool valve and which pilot operated check may serve both as a maximum pressure limiting valve for the motor port and also as a counter balance valve.

These objects are achieved by the provision of a directional valve assembly for a hydraulic power system comprising a body having a sliding spool of the closed center type arranged to selectively direct inlet fluid to either of two motor ports, load holding check valves between the spool and each motor port, combined counterbalance and relief check valves one connected between each motor port and a return port, and each having a control piston exposed through a restriction to its respective motor port pressure, pilot valves for relieving the pressure on the respective control pistons at a pre-determined pressure level, and secondary operating means for the pilot valves each responsive to operating pressure upstream from the load holding check valve for the opposite motor port, whereby each pilot valve controls one check valve to open it either to limit maximum pressure in its own motor port or in response to operating pressure at an opposite motor port.

Figure 1:
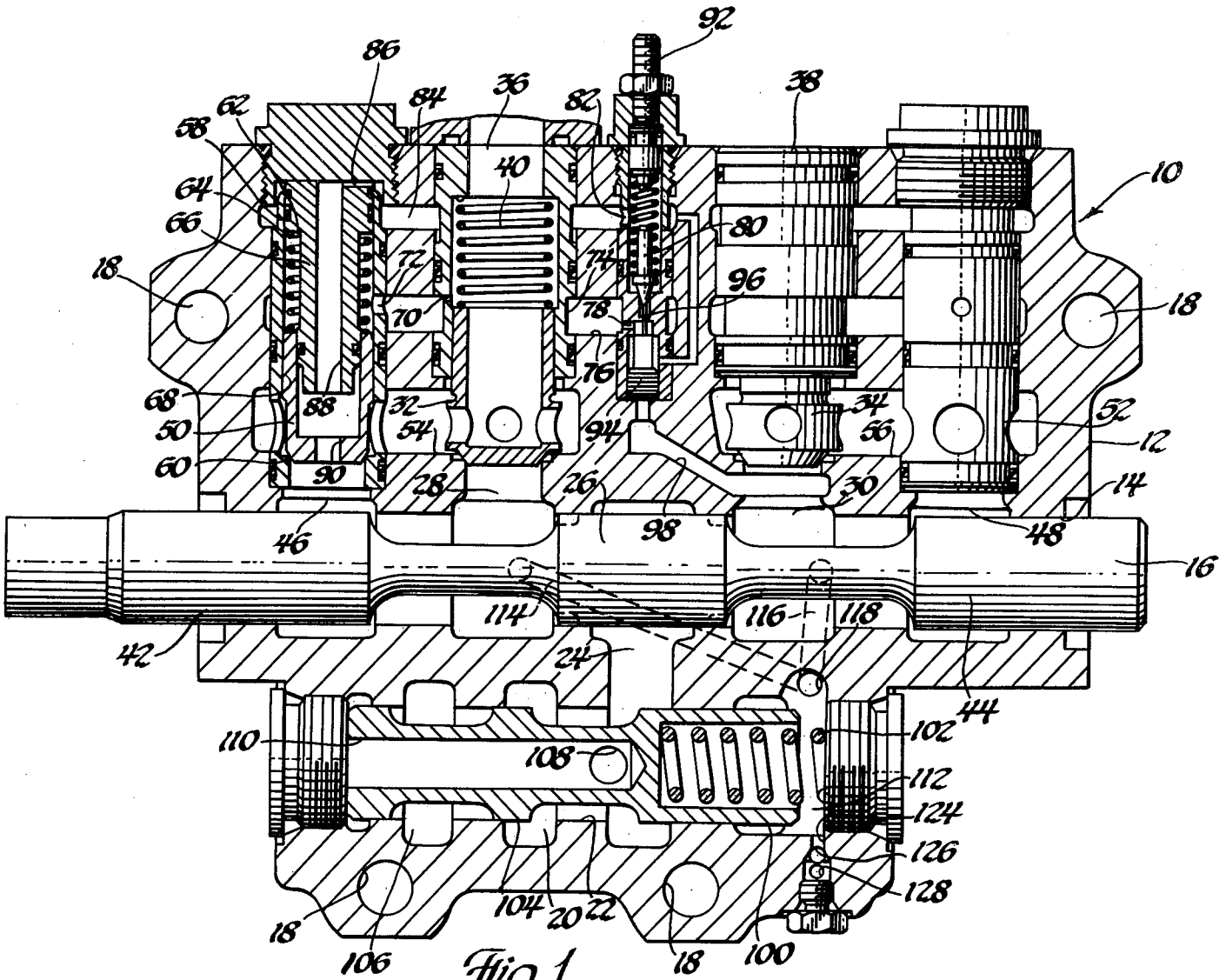
FIG. 1 is a sectional view of a directional valve incorporating a preferred form of the present invention.

The valve 10 of FIG. 1 comprises a body 12 having a principle bore 14 in which is mounted a slideable spool 16. The body 12 is preferably provided with flat sides parallel to the plane of the paper so that it may be stacked with similar valves and bolted together through bolt holes 18. The body has an inlet port 20 communicating through a bore 22 with a pressure port 24, being an enlargement of the bore 14 at its center. A land 26 on the spool 16 closes the port 24 in centered position of the spool 16. When the spool is shifted to the right or left, pressure port 24 is connected to port 28 or port 30. These ports lead through check valves 32 and 34 to motor or service ports 36 and 38. The check valves are biased to their seats by springs such as 40 and serve to prevent undesired backflow through the motor port which would otherwise be caused by gravity or other forces acting on a fluid motor.

The spool 16 has end lands 42 and 44 which in the centered position connect the ports 28 and 30 with tank or return ports 46 and 48 which extend through the bank of valves from end to end. This connection need not be a large one since it is only required to carry the small discharge flow from certain pilot valves to be described later. Above the ports 46 and 48 there are mounted pilot operated check valves 50 and 52 which control communication from a passage 54 to port 46 and from a passage 56 to port 48. The passages 54 and 56 are open to flow returning from the motor ports 36 and 38 and are blocked off from bore 14 by the respective check valves 32 and 34. Thus, when either valve 50 or 52 is opened, by means later to be described, flow returning from the motor passes directly to the tank or return passage 46 or 48 even though the spool 16 has been shifted to block communication between port 28 and tank port 46 or between port 30 and tank port 48. For this purpose, it is not necessary that the fit between lands 42 or 44 and the bore 14 be an extremely close one since they have nothing to do with controlling return flow from the motor ports 36 and 38.

The construction of check valve 52 is similar to that of check valve 50 which includes a stationary sleeve 58 having a seat 60 on which the check valve 50 rests normally, being biased by the spring 62 and also by the fluid pressure in a chamber 64. A stationary spud 66 on which the valve 50 slides limits the area over which this pressure in chamber 64 is effective. The bore 68 in the sleeve 58 is somewhat larger than the seat 60 resulting in an annular area over which the pressure in passage 54 can act to lift the check valve 50 off from its seat 60.

The chamber 64 is in communication with the motor port 36 through a restricted orifice 70 and a hole 72. A passage 76 also connects chamber 64 by way of an annular groove 74 with the inlet port 78 of a pilot relief valve 80. Relief valve 80 has an exhaust port 82 which leads by way of a passage 84, notch 86, and central bores 88 and 90 to the tank port 46. Thus the check valve 50 can act as a maximum pressure limiting valve for the motor port 36. When that pressure reaches a value sufficient to open the pilot valve 80 as determined by the setting of its adjusting screw 92 and the flow through the valve 80 has been sufficient to cause a significant pressure drop through the orifice 70 the pressure in chamber 64 will drop sufficiently to permit the full motor pressure acting on the annular area of check valve 50 to open the latter and thus relieve the excessive pressure in the motor port 36.

The check valve 50 also serves as a counterbalance valve by reason of a small pilot piston 94 having a stem 96 capable of lifting the pilot valve 80 when piston 94 is raised. For this purpose a passage 98 connects the bottom face of piston 94 with the port 30 so that a certain small degree of forward operating pressure in port 30 must be developed before the check valve 50 will open to allow return flow from the motor port 36.

While the pilot valve 80 and its associated parts have been illustrated as in the same plane as the four check valves, it will be understood that it is preferably somewhat behind that plane, and that in front of that plane a similar pilot valve and associated structure is provided for controlling the other check valve 52.

For controlling the inlet flow to the pressure port 24 there is provided a compensator valve 100 slidable in the bore 22 and biased to the left by a spring 102. The valve 100 has a land 104 which opens communication between inlet port 20 and pressure port 24 in the position illustrated. When shifted to the right, inlet port 20 is connected instead to carry-over port 106 leading to the inlet port of the next sectional valve downstream; or to the tank if this section happens to be the last section in the bank. The inlet port 20 may receive fluid from the carry over port 106 of an upstream sectional valve or, if it is the first valve in the bank, directly from the pump delivery line.

Valve 100 is exposed to pressure in port 24 over its left hand end through a hole 108 and a bore 110, thus tending to limit the pressure in pressure port 24. Preferably, the chamber 112 at the right end of the bore 22 is connected with whichever one of the motor ports 28 or 30 is under the higher pressure at any time. This enables the compensator 100 to sense the load on the motor being controlled by the valve and to maintain a constant pressure drop between the pressure port 24 and the active one of the motor ports 28 or 30. This communication is established by passages 114 and 116 respectively leading from the motor ports 28 and 30 to the shuttle valve 118, the output of which connects to the chamber 112.

Figure 2:
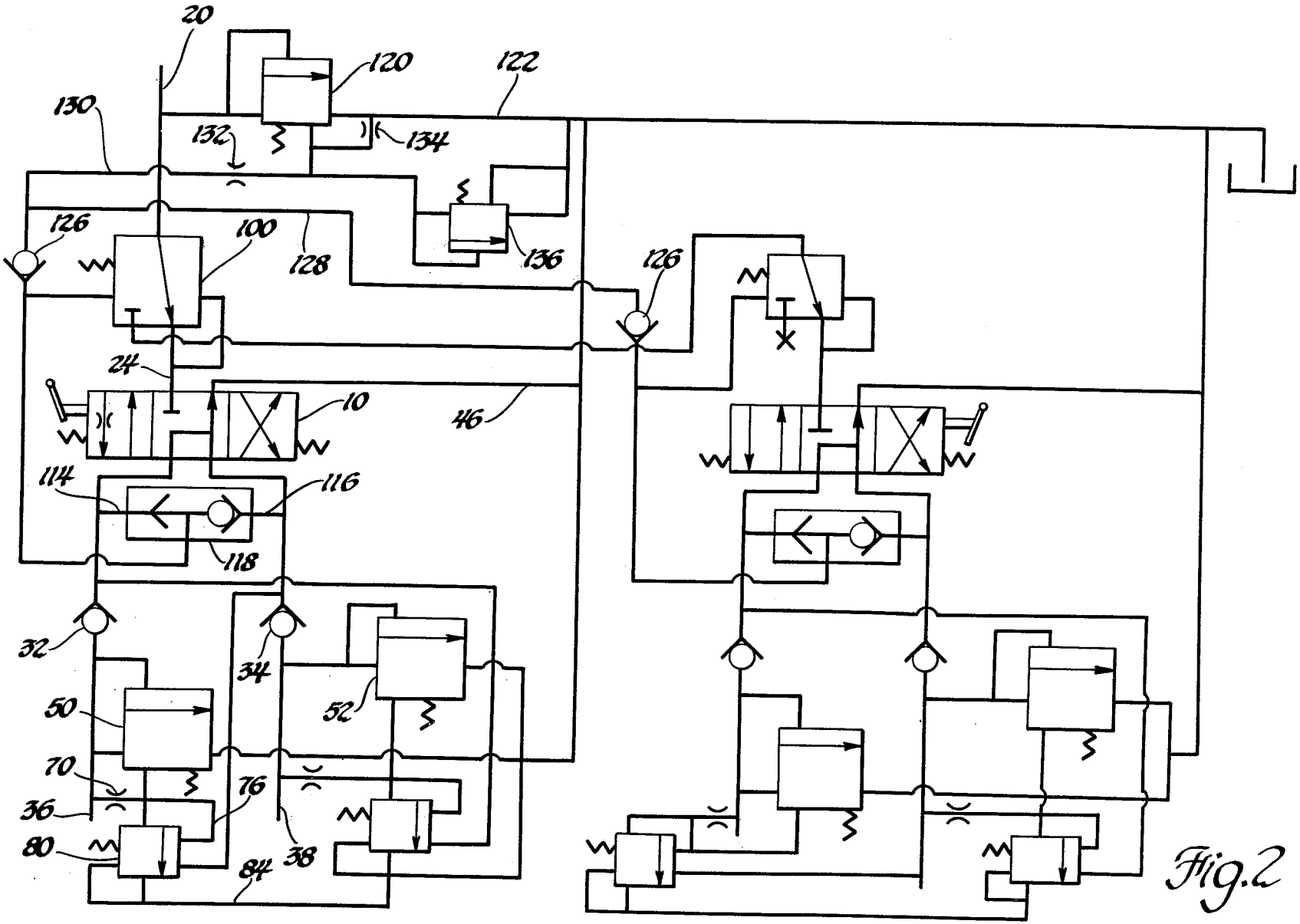
FIG. 2 is a circuit diagram of a power transmission system incorporating the valve of FIG. 1.

Preferably, there is provided outside of the valve body 12 a system compensating valve which is load responsive and is indicated diagrammatically at 120 in FIG. 2. This receives motor operating pressure from whichever valve in the bank of valves has the higher motor operating pressure and serves to spill off to tank through conduit 122 whatever fluid is not required for operating the motor or motors then being used. For this purpose a conduit 124, FIG. 1, a check valve 126 and a cross conduit 128 are provided in each valve section. These communicate by a conduit 130, FIG. 2, and restrictor 132 with the operating chamber of valve 120. A small bleed orifice 134 serves to slowly bleed that operating chamber allowing the valve to open at times when all of the spools are centered. In other words, it avoids trapping of fluid in the operating chamber of valve 120 when both check valves 126 are closed. A pilot relief valve 136 may also be provided, causing the valve 120 to limit maximum pressure in the pump delivery line 20.

I claim:

1. A directional valve assembly for hydraulic power systems comprising a body having a sliding spool of the closed center type arranged to selectively direct inlet fluid to either of two motor ports, load holding check valves between the spool and each motor port, combined counter balance and relief check valves, one connected between each motor port and a return port and each having a control piston exposed through a restriction to its respective motor port pressure, pilot valves for relieving the pressures on the respective control pistons at a predetermined pressure level, and a secondary operating means for the pilot valves each connected directly to the sliding spool valve at a point upstream from the load holding check valve for the opposite motor port, whereby each pilot valve controls one check valve to open it, either for limiting maximum pressure in its own motor port or in response to operating pressure at an opposite motor port.

2. A valve as defined in claim 1 wherein the spool axis and the four check valve axes are in a common plane with the check valve axes perpendicular to the spool axis.

3. A valve as defined in claim 2 having an unloading spool for the inlet with its axis parallel to the spool axis and on the opposite side of the spool from the check valves.

* * * * *